United States Patent [19]

Marks

[11] Patent Number: 4,524,650

[45] Date of Patent: Jun. 25, 1985

[54] SQUEEZE-RATCHET TOOL ASSEMBLY

[76] Inventor: Joel S. Marks, 10508 Wilkins Ave., Los Angeles, Calif. 90024

[21] Appl. No.: 495,673

[22] Filed: May 18, 1983

[51] Int. Cl.[3] ..... B25B 13/46

[52] U.S. Cl. ..... 81/57.39; 74/89.15; 173/170

[58] Field of Search ..... 81/57.39, 57.29; 145/53; 173/18, 170; 74/89.15, 424.8 B

[56] References Cited

U.S. PATENT DOCUMENTS

| | | | |
|---|---|---|---|
| 2,301,413 | 11/1942 | Kilcup | 145/53 |
| 2,421,901 | 6/1947 | Murad et al. | 145/53 |
| 2,594,669 | 4/1952 | Marshall | 81/57.29 |
| 2,718,165 | 9/1955 | Bourassa et al. | 74/424.8 B |
| 3,049,018 | 8/1962 | Lusskin et al. | 74/89.15 |
| 3,733,936 | 5/1973 | Flynn | 81/57.29 |
| 4,249,617 | 2/1981 | Cox | 81/57.39 |

*Primary Examiner*—James L. Jones, Jr.
*Attorney, Agent, or Firm*—Keith D. Beecher

[57] ABSTRACT

A two-part tool assembly comprising a squeeze wrench section and a ratchet wrench section adapted to be fitted into one another. The squeeze wrench section serves to convert squeezing motion into rotary motion on a variable torque basis, and the ratchet wrench section transmits the rotary motion to the screw or bolt which is being tightened or loosened. In one embodiment, a curved lever is included in the squeeze wrench section in conjunction with a handle to provide a traveling fulcrum, so that when the handle is squeezed maximum torque is generated at the beginning of the stroke and maximum speed is realized at the end of the stroke. In a second embodiment, the variable torque is provided by changing the angle of spiral cuts along a drive shaft in the squeeze wrench section, so that the spiral cuts become more axial towards the front end of the section, and by directly coupling a slider on the shaft to the squeeze handle. The squeeze wrench section and the ratchet wrench section are also adaptable to be used separately and independently of one another.

9 Claims, 6 Drawing Figures

SQUEEZE-RATCHET TOOL ASSEMBLY

BACKGROUND OF THE INVENTION

The two-part tool assembly of the invention is intended primarily to overcome the limitation inherent in the prior art ratchet wrenches. This limitation occurs because the prior art ratchet wrenches exert a constant torque on the bolt being turned, and accordingly, when such a ratchet wrench is designed to exert sufficient torque initially to loosen a bolt, that torque persists when the bolt has been loosened and when it is not needed. This means that the prior art ratchet wrenches must be designed to incorporate more handle motion than is actually required for a particular operation, which is especially troublesome where space and/or accessibility are limited.

Unlike the prior art ratchet wrench, the tool of the present invention automatically matches the available torque with the torque required for a particular operation, this being achieved by varying the torque. This results in the particular operation being performed with a maximum speed for present torque requirements.

The two-part tool system of the invention in the embodiment to be described includes a squeeze wrench section and a ratchet wrench section which may be inserted into one another. When the two sections are used in combination, certain advantages are realized, including the following: (a) in the resulting ratchet wrench, the variable torque of the tool automatically matches the required stroke, and squeeze strokes can become longer as the turning of the bolt becomes easier so as to speed up the removal of the bolt; (b) the full stroke of the squeeze handle provides two-thirds to three-quarters of a turn to the bolt, which is advantageous over the prior art squeeze ratchet wrenches, and over the usual prior art swing-type ratchet wrenches, even for very accessible and exposed bolts, since the two-part tool system of the invention operates much faster than either type of the prior art ratchet wrenches; (c) the combined tool of the invention finds particular utility in the case of bolts for which the turning room is limited, and it operates to permit such bolts to be quickly and conveniently removed; (d) the combined tool of the invention also finds practical utility in the removal of bolts which are too loose to enable the usual ratchet wrench to be used because of the tendency of the bolt to turn on the back stroke, and yet which are too tight or inaccessible to permit hand removal, such bolts being quickly and easily removed by the combined tool of the invention. The combined tool also finds utility in the installation of nuts and bolts with dirty or damaged threads which requires a smooth, fast and highly controlled turning motion, and which requires that they be held squarely and firmly.

As mentioned above, the ratchet wrench section of the combined tool of the invention may be operated by itself and independently of the squeeze wrench section. When the ratchet wrench section is operated alone for removing bolts requiring low to moderately high torques, for example, a screwdriver-like tool can be inserted into the rear of the ratchet handle, allowing the bolt to be turned by the head of the ratchet handle where room to turn the handle itself is limited or nonexistent. The torque is multiplied about three times by the ratchet wrench section. A flexible cable drive may be used in conjunction with the ratchet wrench section to provide further remote access.

Likewise, the squeeze wrench section may be operated alone, for example, as a screwdriver or wrench. When so used, the squeeze wrench section provides variable torque automatically to match its turning ability with the turning requirements. The squeeze wrench section may be coupled to screwdriver bits to be used as a screwdriver, and when so used, the axial push into the screw can be controlled independently of the turning torque, which is especially useful when removing screws from worn holes. The squeeze wrench section uses a mechanism similar to the well-known "spiral ratchet screwdriver". However, as compared with the "spiral ratchet screwdriver", the squeeze wrench section of the invention enables looser screws to be turned more quickly with the squeezing motion than with the arm pushing motion of the "spiral ratchet screwdriver". Also, tighter screws can be withdrawn or inserted with a minimum of effort in the high torque part of the stroke of the squeeze wrench section of the invention. Also, controlled one-handed operation is possible with the squeeze wrench section.

It is, accordingly, an object of the present invention to provide an inexpensive two-part squeeze-ratchet wrench assembly which is light and easily portable, which is more compact than a power tool, and which is often as efficient, and which may be used in spaces which are inaccessible to usual air ratchet tools, and the like. The two-part tool of the invention operates with the same speed as air socket wrenches for the lower torques commonly encountered in turning bolts. The variable torque feature of the squeeze wrench section of the invention provides accurate control of the amount of bolt turns since smaller strokes allow increasingly smaller turn angles.

DETAILED DESCRIPTION OF THE ILLUSTRATED EMBODIMENT

Figure 1:
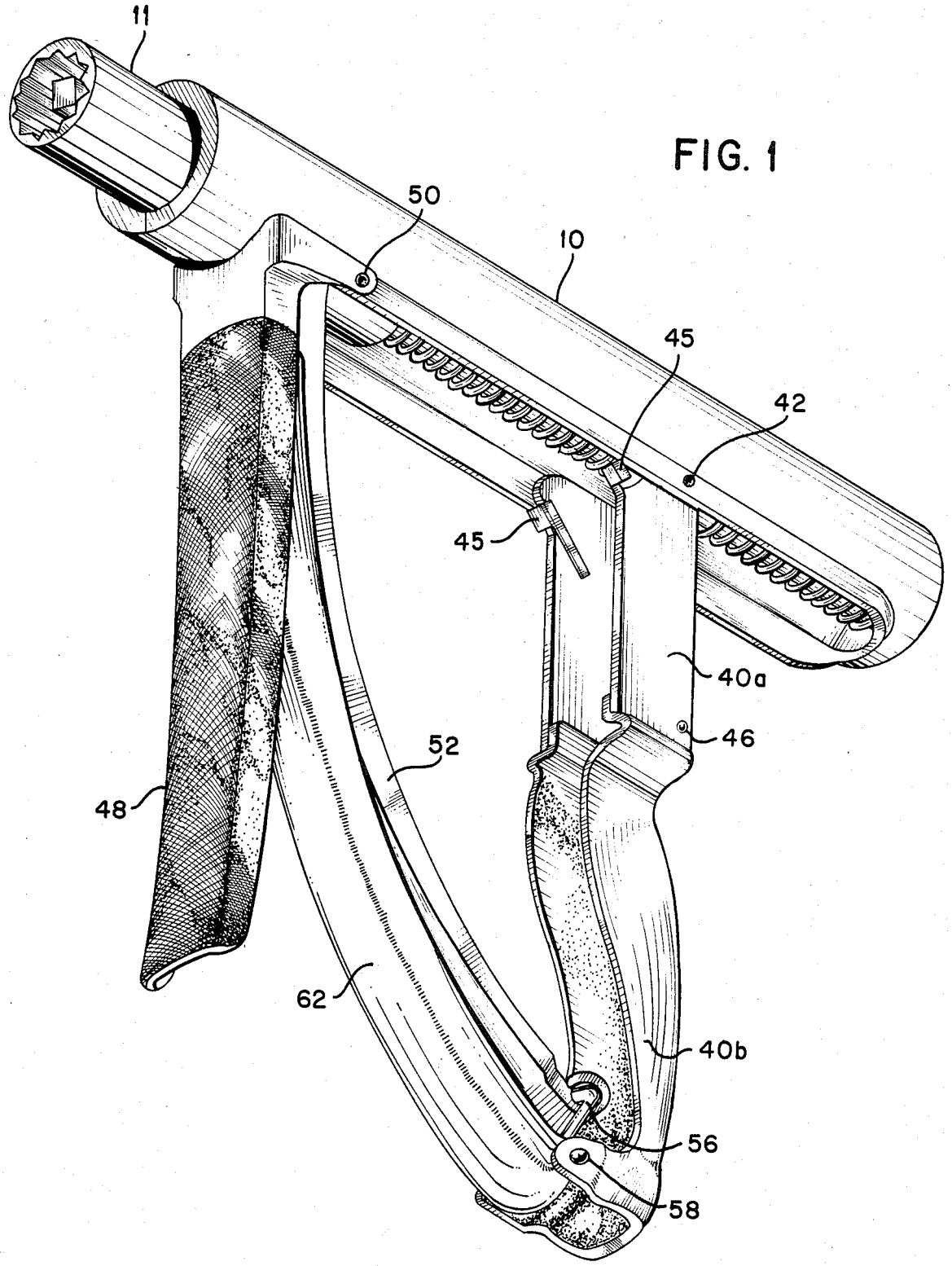
FIG. 1 is an isometric representation of a squeeze wrench section constructed in accordance with one embodiment of the invention.
Figure 2:
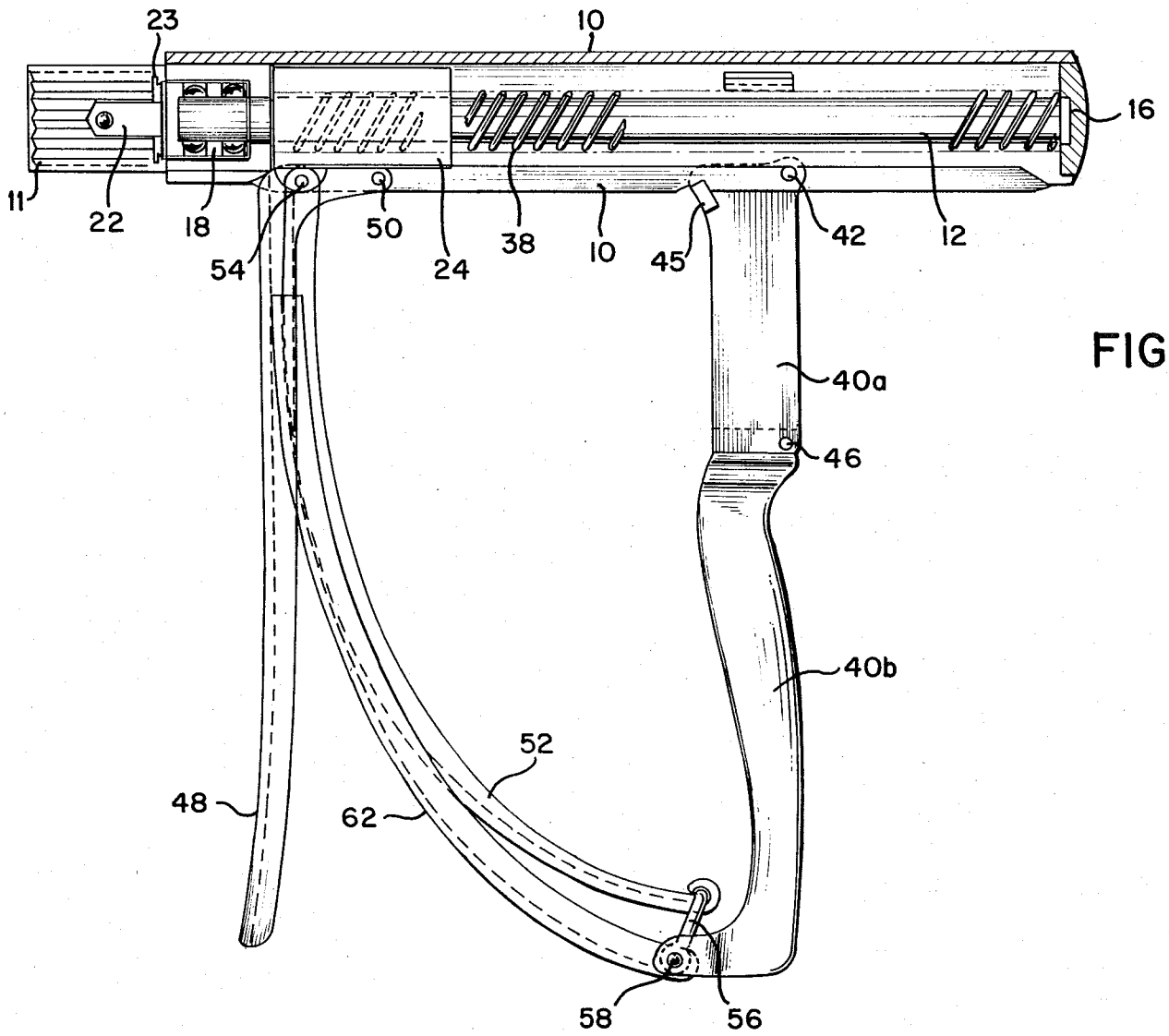
FIG. 2 is a side elevation, partly in section, of the squeeze wrench section of FIG. 1, with its grip handle in an extended position.
Figure 3:
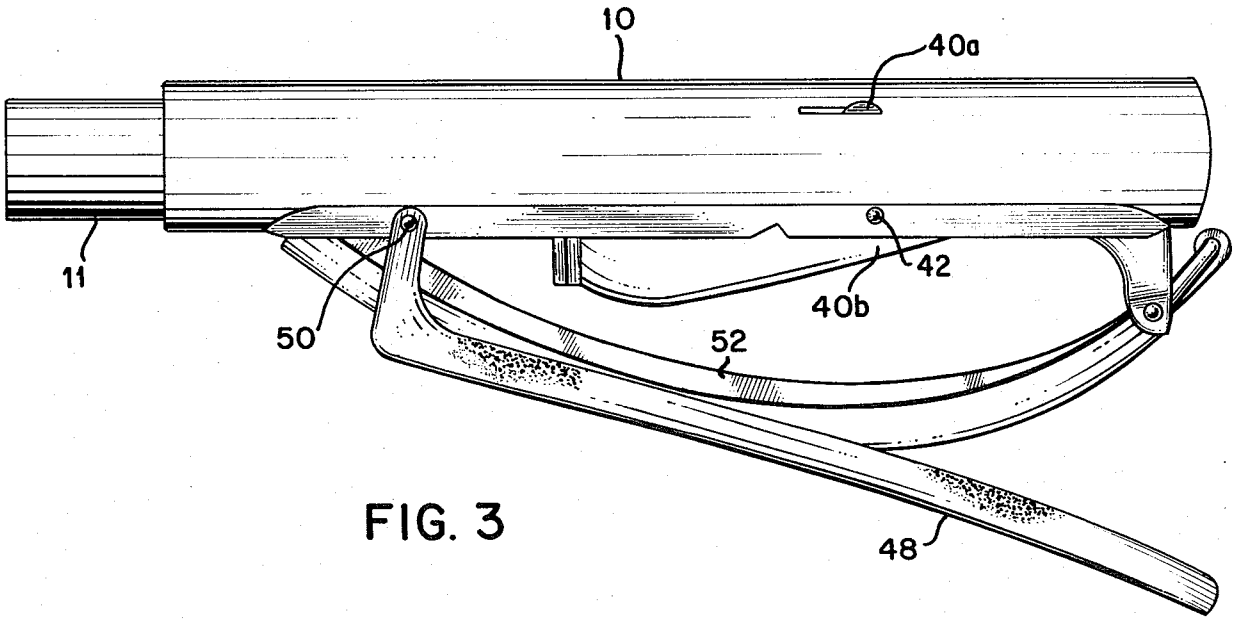
FIG. 3 is a side elevation of the squeeze wrench section of FIG. 1 with its grip handle, and other components, in a folded position.
Figure 4:
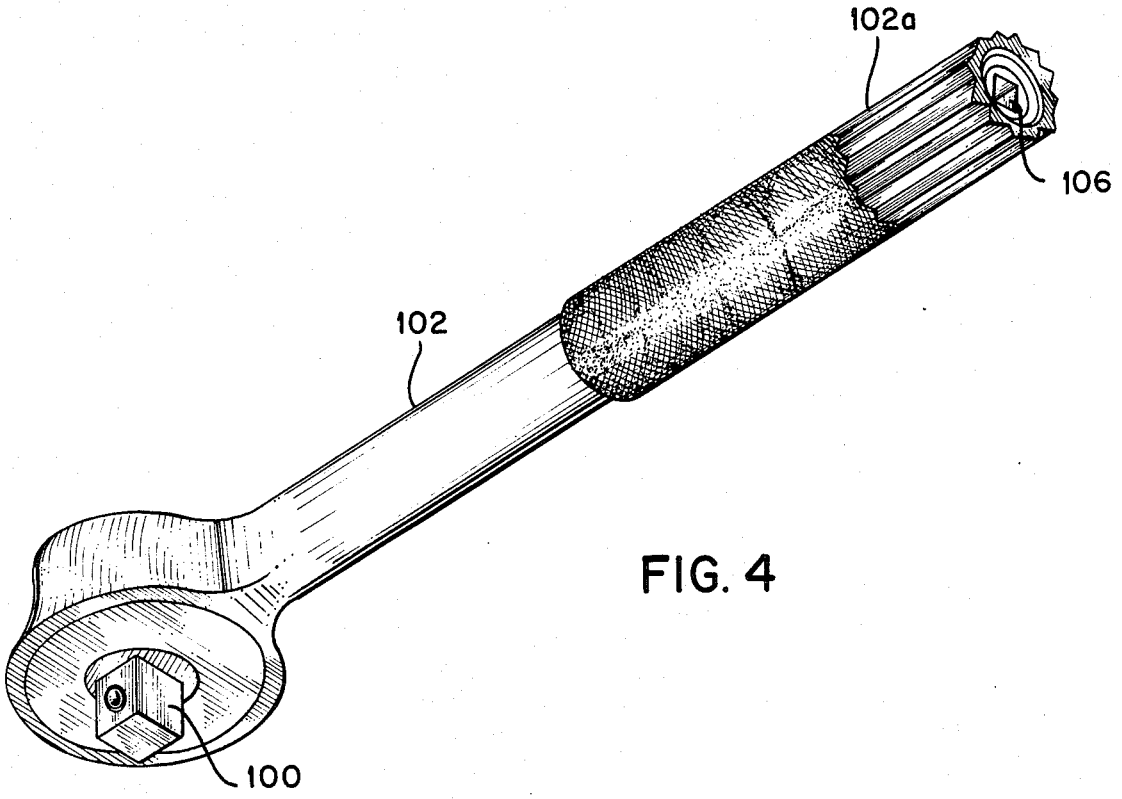
FIG. 4 is an isometric view of a ratchet wrench section constructed in accordance with one embodiment of the invention.
Figure 5:
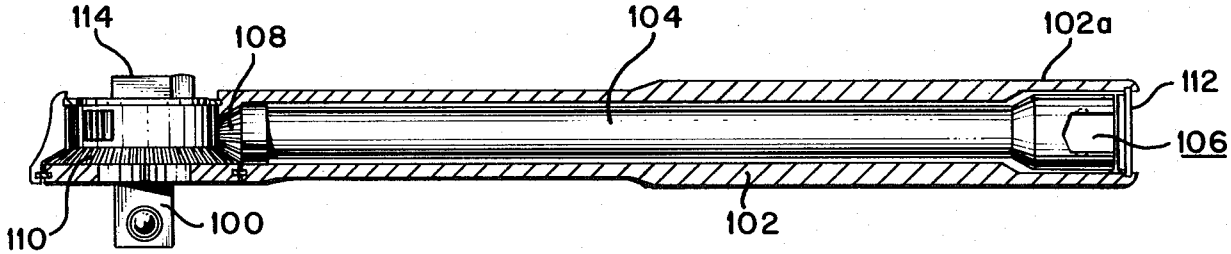
FIG. 5 is a side elevation, partly in section, of the ratchet wrench section of FIG. 4.
Figure 6:
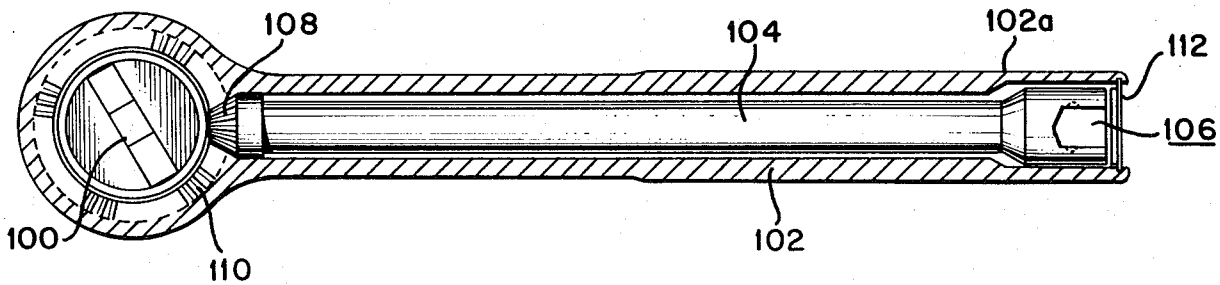
FIG. 6 is a side elevation, partly in section, of the ratchet wrench section of FIG. 3, turned 90° on its longitudinal axis as compared with the view of FIG. 5.

The two main components of the two-part tool system of the invention are illustrated in the drawings. A further component which is not illustrated is a flexible drive which may be used to connect the two sections of the tool system. This flexible drive may be of conventional construction, with fittings at each end to match the tool sections it connects. It may be similar to a speedometer cable, but stronger, and preferably more flexible than a speedometer cable. The squeeze handle section is illustrated in FIGS. 1–3. This section is used to convert a squeezing motion into a rotary motion by means of a varying torque mechanism. The ratchet wrench section is shown in FIGS. 4–6. This section has the configuration of a conventional ratchet wrench but with the additional capability of being driven from the rear end of the handle.

The squeeze wrench section shown in FIGS. 1–3 includes an elongated main body 10 having a modified socket 11 welded in one end thereof. Socket 11 enables the squeeze wrench section to be coupled to the ratchet wrench section of FIGS. 4–6, as will be described, either directly or through a flexible drive cable.

A "spiral ratchet" screwdriver torque transmitting shaft 12 is rotatably mounted in bearings 16 and 18 positioned at opposite ends of body 10, and this shaft extends within the body 10 coaxially along its length. A circlip 23 may be used to hold the shaft 12 in body 10. A drive tip 22 is mounted at the end of shaft 12 for coupling the shaft to a corresponding shaft in the ratchet wrench section, or to permit wrench sockets and/or screwdriver bits to be attached to the end of shaft 12, when the squeeze wrench section is used alone. A torque limiter may be built into the assembly between drive tip 22 and bearing 18.

As shown in FIG. 2, a pair of spiral grooves extend along the length of shaft 12, and a conventional "spiral ratchet" screwdriver slider 24 is moved along the shaft, to cause the shaft to rotate. A conventional direction controller (not shown) is provided on slider 24 to cause shaft 12 to turn in one direction or the other when the slider is drawn along the shaft towards the rear end of body 10. A return spring 38 is provided for returning the slider to the forward end of body 10.

A two-piece grip handle 40*a*, 40*b* is mounted on the main body 10, and the grip handle normally projects downwardly from the main body 10, as shown in FIGS. 1 and 2. Section 40*a* of the grip handle is attached to main body 10 by a pin 42, and the two sections 40*a*, 40*b* of the grip handle are hinged together by a pin 46. The grip handle may be folded about the pins 42 and 46 when not in use in order to conserve space, as shown in FIG. 3. A latch 45 holds the handle in its extended operating position of FIGS. 1 and 2 by the bias of a spring (not shown) which is bonded to the latch. In order to convert the assembly from the configuration of FIGS. 1 and 2 to the folded configuration of FIG. 3, it is necessary to release latch 45.

An elongated squeeze handle 48 is pivotally coupled to body 10 by a pin 50. A pulling lever 52 is coupled to slider 24 by means of a pin 54 (FIG. 2), and lever 52 is hinged to the end of the grip handle section 40*b* by a link 56. Link 56 is pivoted at one end to the grip handle section 40*b* by a pin 58, and it is pivoted at its other end to the pull lever 52. A curved varying force transmitting lever 62 is pivoted at one end to the grip handle 40*b* by pin 58, and it fits over pull lever 52. The curved lever 62 engages squeeze handle 48 in a sliding and rolling relationship, lever 62 being interposed between the squeeze handle 48 and the pull lever 52. The squeeze handle 48, levers 52 and 62, body 10, and the grip handle 40*a*, 40*b* may all be formed by stamping out metal sheets.

Squeeze handle 48, levers 62, 52, and link 56 work together to provide the variable torque feature of the illustrated embodiment by a traveling fulcrum. The fulcrum is the tangency point between squeeze handle 48 and lever 62. This point is never higher than the top of lever 62. The torque, therefore, cannot be infinite. Link 56 allows for the changing distance between lever handle 52 and the slider 24. Levers 52 and 62 should contact each other only near their upper ends, where lever 62 ends. Since substantial friction may occur here, a roller bearing may be desirable at this point, otherwise smooth surfaces are required.

Squeeze handle 48 has a rearwardly extending pivot axis established by pin 50 in order to accommodate the hand motion when squeezing, and also to facilitate folding of the assembly. The squeezing handle slides along the outer surface of lever 62 and, accordingly, these surfaces must be reasonably smooth.

To operate the squeeze wrench section of FIGS. 1–3, the operator grasps the assembly with his hand around the grip handle 40*a*, 40*b*, and with his fingers around the squeeze handle 48. The design of grip handle 40*b* anticipates holding with the thumb either towards or away from the main body 10. Then, as the squeeze handle 48 is squeezed, it is drawn towards the grip handle 40*a*, 40*b*, and the movement of the squeeze handle is transmitted through the varying force transmitting lever 62 to the slider pull lever 52, causing slider 24 to be pulled toward the rear of main body 10 against the force of spring 38. When the squeeze handle 48 is subsequently released, the return spring 38 moves slider back to the forward end of the assembly to the position shown in FIG. 2.

As slider 24 is pulled towards the rear of the torque transmitting shaft 12, the shaft is caused to rotate in one direction or the other, depending upon the setting of the ratchet lock controller (not shown) on the slider. Then, when the squeeze handle 48 is released, return spring 38 moves the slider 24 back to the position shown in FIG. 1 without any rotation of shaft 12, due to the action of the conventional internal components of slider 24.

The provision of squeeze handle 48, and levers 52 and 62 provides the variable torque feature of the squeeze wrench section of FIGS. 1–3. This squeeze handle and associated levers provide for maximum torque at the beginning of the stroke, and for maximum turning speed at the end of the stroke, as is desired for the efficient use of the tool. As explained above, levers 52 and 62 work together to provide the variable torque feature.

As explained above, the variable torque feature may be provided by appropriately shaping the spiral cuts in the drive shaft 12. Then, a squeeze handle analogous to squeeze handle 48 may be directly coupled to the slider 24, and a variable torque exerted to shaft 12 due to the particular configuration of the spiral cuts in the shaft.

The second section of the two-part tool system of the invention is illustrated in FIGS. 4–6, and it constitutes a ratchet wrench section which may be coupled, for example, either directly or through a flexible cable to the squeeze wrench section of FIGS. 1–3. The ratchet wrench section shown in FIGS. 4–6 includes an elongated tubular housing 102 which also may serve as a handle. A shaft 104 extends within the tubular housing coaxially along its length. When the two sections are coupled directly to one another, the socket 11 of the squeeze wrench section of FIG. 1 is received on the rear end 102*a* of the tubular housing 102 of the ratchet wrench section of FIG. 4, with the square drive tip 22 of the assembly of FIG. 1 extending into a female square drive socket 106 at the rear end of shaft 104. The rear end 102*a* of tubular housing 102 is appropriately shaped, as shown in FIG. 4, to fit into and not rotate in socket 11 of the squeeze wrench section of FIG. 1. In this manner, the torque generated by shaft 12 of the squeeze wrench section of FIG. 1 is transmitted to shaft 104 of the ratchet wrench section of FIG. 4.

Shaft 104 is coupled to a square drive tip 100 through a pinion 108 and a bevel gear 110. The handle 102 is coupled to drive tip 100 through a usual ratchet drive (not shown), the direction of the ratchet drive being selected by a conventional direction controller selector bar 114.

The usual socket wrench sockets or screwdriver bits may be mounted on the square drive tip 100 when the ratchet wrench section of FIG. 4 is used with the squeeze wrench section or alone. Bearings are provided at each end of the tubular housing 102 for receiving the ends of shaft 104. Shaft 104 is held in the tubular housing by a thrust washer and circlip 112 mounted at the rear end of the housing.

The invention provides, therefore, a two-section tool system which has been developed primarily to address a very common problem in turning operations; that is, the fact that the available torque in a conventional prior art ratchet wrench is usually far greater than needed for most removing and replacing operations on a bolt. This leads to an inefficient motion, as described above, especially when accessibility is limited. Moreover, unlike the prior art squeeze operated ratchet wrenches, the squeeze wrench section of the two-part tool assembly of the invention allows the available torque to match the requirement, and achieves this automatically through a varying torque mechanism. The speed of operation is thereby maximized, while maintaining maximum torque capability.

As described above, each section of the two-part tool system of the invention is useful by itself. Moreover, the squeeze wrench section has been designed to minimum dimensions, and to fold so that it may be easily carried with minimum space requirements; and the ratchet wrench section has been designed to have the conventional appearance and to operate in the conventional manner.

Many commonly available tool components have been used in the construction of both sections of the two-part tool system of the invention to minimize production costs.

When the squeeze wrench section is used alone in conjunction with a screwdriver bit or a wrench socket, it provides variable torque automatically to match turning ability with turning requirements; axial push into a screw can be controlled independently of turning torque, unlike the "spiral ratchet" screwdriver, which is especially useful when removing screws from worn wood holes; looser screws can be driven more quickly with the squeezing motion than with the arm pushing motion of the "spiral ratchet" screwdriver; tighter screws can be driven with minimum effort in the high torque part of the stroke; and the squeeze wrench section allows easy access to screws near walls or other confined spaces.

The ratchet wrench section can be used alone in usual manner, and for low to moderately high torques, a screwdriver-like tool can be inserted into the rear end of the section causing a bolt to be turned by the ratchet section when there is no room to swing the handle itself.

When the two sections are used together, they provide variable torque which automatically matches turning ability with turning requirements. Squeeze strokes can become longer when turning becomes easier. A full stroke provides approximately $\frac{2}{3}$ to $\frac{3}{4}$ of a turn. This is an advantage over the prior art squeeze ratchet wrenches and over the conventional ratchet wrenches even for very accessible and exposed bolts. The action is faster than turning by fingers except for extremely loose and accessible bolts, so that the temptation to remove the wrench and use the fingers is obviated since no speed advantage would be gained. Moreover, using the combined sections of the tool system of the invention is much faster than swinging a conventional ratchet wrench.

Even when the torque requirement is too high to achieve a full stroke, a speed advantage is gained in most cases by using the combined sections of the tool of the invention for both inaccessible and accessible bolts. It is to be noted that the distance traveled by the slider is amplified over that traveled by the squeeze lever.

The two-part tool system of the invention is highly portable, less costly, and more compact than a power tool. The two-part tool of the system can be used in many spaces inaccessible to an air ratchet wrench. It is at least as fast as an air ratchet wrench when used for the lower torques commonly encountered in turning bolts, and faster for the lowest torques.

When the flexible interconnector is not used, the combined tool is capable of one-handed operation both to squeeze the trigger handle and to react to the torque generated at the bolt.

The ratchet wrench section of the two-part tool system of the invention can be connected to an electric drill, if so desired, and the resulting assembly may be used with or without a flexible drive cable. The assembly then becomes a power tool with increased turning power over any hand tool, but with a compactness and versatility previously available only with hand tools.

It will be appreciated that while a particular embodiment of the invention has been shown and described, modifications may be made. It is intended in the claims to cover all modifications which come within the true spirit and scope of the invention.

What is claimed is:

1. A two-part tool system comprising: a squeeze wrench section and a ratchet wrench section; said ratchet wrench section including: an elongated tubular housing having an open rear end, a drive head rotatably mounted on the forward end of the housing, a drive shaft for the drive head extending coaxially within the housing and having its rear end exposed through the open rear end of the housing; said squeeze wrench section including: an elongated housing, a grip handle attached to the housing and extending outwardly from the housing, a squeeze handle having one end pivotally attached to the housing and extending outwardly from the housing in essentially spaced and parallel relationship with the grip handle, a further drive shaft having at least one helical channel rotatably mounted in the housing and extending coaxially along the housing and having its forward end exposed through the end of the housing, a coupling mechanism intercoupling the squeeze handle to the further drive shaft so that pivotal movement of the squeeze handle produces rotational motion of the further drive shaft, said coupling mechanism including a slider which engages the helical channel on the further drive shaft and which is moved along the drive shaft upon pivotal movement of the squeeze handle to impart rotational motion to the drive shaft on a variable torque basis so that maximum torque is generated at the beginning of each squeeze stroke and maximum speed is generated at the end of each squeeze stroke of the squeeze handle, and coupling means for intercoupling the front end of the squeeze section housing to the rear end of the ratchet section housing and for intercoupling the further drive shaft of the squeeze section to the drive shaft of the ratchet section.

2. The two-part tool system defined in claim 1, in which said coupling mechanism further includes a curved lever contacting the squeeze handle in sliding and rolling engagement therewith and pivotally attached to said slider at one end thereof, and means coupling the other end of the curved lever to the distal end of the grip handle, the sliding and rolling engagement of the curved lever with the squeeze handle serving to provide a traveling fulcrum for the curved lever.

3. The two-part tool system defined in claim 1, in which the grip handle of the squeeze wrench section is hinged to the housing to permit the squeeze wrench section to have a folded configuration.

4. The two-part tool system defined in claim 1, in which said further drive shaft has two helical channels, and in which said slider selectively engages the two channels to cause the drive shaft to rotate in either of two directions as the slider is moved towards the rear end of the channels, and in which said slider selectively engages the two channels to cause the drive shaft to rotate in either of two directions as the slider is moved towards the rear end of the drive shaft by the squeeze handle, and in which the slider is disengaged from the helical channels when the slider is returned to the forward end of the drive shaft, and which includes a return spring for biasing the slider towards the forward end of the drive shaft.

5. A variable torque driver comprising: an elongated housing having an open front end, a grip handle attached to the housing and extending outwardly from the housing, a squeeze handle pivotally mounted to the housing and extending outwardly from the housing in essentially spaced and parallel relationship with the grip handle, a drive shaft having at least one helical channel rotatably mounted in the housing extending coaxially along the housing and having its forward end exposed through the open front of the housing, a coupling mechanism interconnecting said squeeze handle to said drive shaft so that pivotal movement of the squeeze handle produces rotational movement of the drive shaft, and coupling means mounted on the front end of the housing for coupling the drive shaft to a driven element, said coupling mechanism including a slider which engages the helical channel in the drive shaft and which serves to convert the pivotal movement of the squeeze handle to a rotational motion of said drive shaft on a variable torque basis so that maximum torque is generated at the beginning of each squeeze stroke and maximum speed is generated at the end of each squeeze stroke of said squeeze handle.

6. A variable torque driver including: an elongated housing having an open front end, a grip handle attached to the housing and extending outwardly from the housing, a squeeze handle pivotally mounted at one end of the housing and extending outwardly from the housing in essentially spaced and parallel relationship with the grip handle, a drive shaft rotatably mounted in the housing and extending coaxially along the housing and having its forward end exposed through the open front end of the housing, a coupling mechanism interconnecting said squeeze handle to said drive shaft so that pivotal movement of the squeeze handle causes the drive shaft to rotate, said coupling mechanism including a curved lever contacting the squeeze handle in sliding and rolling engagement therewith and pivotally coupled at one end to said slider, and means coupling the other end of said curved lever to the distal end of the grip handle, the sliding and rolling engagement of the curved lever with the squeeze handle providing a traveling fulcrum for the curved lever so that the pivotal movement of the squeeze handle is converted to the rotational movement of the shaft on a variable torque basis in order that maximum torque may be generated at the beginning of each squeeze stroke and maximum speed may be generated at the end of each squeeze stroke of the squeeze handle, and coupling means mounted on the forward end of the housing for coupling the drive shaft to a driven element, said drive shaft including at least one helical channel, and said coupling mechanism including a slider which engages the helical channel and which is moved along the drive shaft by the squeeze handle to impart rotary movement to the drive shaft.

7. The combination defined in claim 6, in which the grip handle is hinged to the housing to permit the wrench assembly to have a folded configuration.

8. The combination defined in claim 6, in which said drive shaft has two helical channels, and in which said slider selectively engages the channels to cause the drive shaft to rotate in either of two directions as the slider is moved towards the rear end of the drive shaft, and in which the slider is disengaged from the channels when the slider is moved towards the forward end of the drive shaft.

9. The combination defined in claim 8, and which includes a return spring for biasing the slider towards the forward end of the drive shaft.

* * * * *